US010559911B2

(12) United States Patent
Herbrechtsmeier

(10) Patent No.: US 10,559,911 B2
(45) Date of Patent: Feb. 11, 2020

(54) PLUG CONNECTOR MODULE PROVIDING GROUND CONNECTION THROUGH A MODULE HOLDING FRAME

(71) Applicant: HARTING Electric GmbH & Co. KG, Espelkamp (DE)

(72) Inventor: Heiko Herbrechtsmeier, Buende (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/903,048

(22) PCT Filed: Jul. 25, 2014

(86) PCT No.: PCT/DE2014/100271
§ 371 (c)(1),
(2) Date: Jan. 5, 2016

(87) PCT Pub. No.: WO2015/018394
PCT Pub. Date: Feb. 12, 2015

(65) Prior Publication Data

US 2016/0336677 A1 Nov. 17, 2016

(30) Foreign Application Priority Data

Aug. 5, 2013 (DE) ..... 10 2013 108 383

(51) Int. Cl.
*H01R 9/22* (2006.01)
*H01R 9/26* (2006.01)
(Continued)

(52) U.S. Cl.
CPC ..... *H01R 13/514* (2013.01); *H01R 4/48* (2013.01); *H01R 11/01* (2013.01); *H01R 13/518* (2013.01); *H01R 13/6597* (2013.01)

(58) Field of Classification Search
CPC .. H01R 13/514; H01R 9/2608; H01R 13/426; H01R 13/518
(Continued)

(56) References Cited

U.S. PATENT DOCUMENTS 5,151,035 A 9/1992 Kawai et al. ..... 439/95
6,004,162 A 12/1999 Harting et al. ..... 439/701
(Continued)

FOREIGN PATENT DOCUMENTS

DE 29508095 8/1995 ..... H01R 13/514
DE 19707120 6/1998 ..... H01R 13/514
(Continued)

OTHER PUBLICATIONS

International Search Report issued in application No. PCT/DE2014/100271, dated Nov. 14, 2014 (6 pgs).
(Continued)

*Primary Examiner* — Abdullah A Riyami
*Assistant Examiner* — Thang H Nguyen
(74) *Attorney, Agent, or Firm* — Hayes Soloway P.C.

(57) ABSTRACT

An electrical plug connector module and holding frame assembly is provided alone or in combination with further plug connector modules for forming a modular plug connector. The electrical plug connector module is inserted directly in the plug connector housing or can be received fastened in the holding frame with further modules in a plug connector housing. The electrical plug connector module includes an electrical contact that is connected in an electrically conductive manner in the interior of the electrical plug connector module to an electrical contact that is received therein. The electrical contact is guided on the outer side of the electrical plug connector module contacts in
(Continued)

addition by way of a resilient region the holding frame or the plug connector housing in which the electrical plug connector module is inserted.

9 Claims, 6 Drawing Sheets

(51) Int. Cl.
*H01R 13/514* (2006.01)
*H01R 13/518* (2006.01)
*H01R 13/6597* (2011.01)
*H01R 11/01* (2006.01)
*H01R 4/48* (2006.01)

(58) Field of Classification Search
USPC ..... 439/712, 716–717
See application file for complete search history.

(56) References Cited

U.S. PATENT DOCUMENTS

| | | | | |
|---|---|---|---|---|
| 6,354,888 | B1 * | 3/2002 | Cech | H01R 9/2691 439/532 |
| 6,383,036 | B1 * | 5/2002 | Steinhauser | H01R 13/6271 439/357 |
| 6,945,801 | B2 * | 9/2005 | Brown | H01R 13/641 439/188 |
| 6,964,579 | B2 * | 11/2005 | Seminara | F42B 3/26 439/188 |
| 7,537,466 | B2 | 5/2009 | Bartholoma et al. | 439/95 |
| 2001/0002343 | A1 | 5/2001 | Suzuki | 439/101 |
| 2002/0025719 | A1 | 2/2002 | Dingenotto et al. | 439/607 |
| 2007/0249192 | A1 * | 10/2007 | Tsurumi | H01R 13/506 439/94 |
| 2008/0020645 | A1 * | 1/2008 | Fuerst | H01R 13/514 439/620.1 |

FOREIGN PATENT DOCUMENTS

| | | | | |
|---|---|---|---|---|
| DE | 29812500 | | 9/1998 | H01R 13/518 |
| DE | 69413524 | | 2/1999 | H01R 31/02 |
| DE | 202005012756 | | 10/2005 | H01R 13/426 |
| DE | 202011050643 | | 10/2011 | H01R 13/506 |
| DE | 102010022690 | | 12/2011 | H01L 13/652 |
| DE | 102013106279 | A1 * | 12/2014 | H01R 13/514 |
| EP | 0475416 | | 3/1992 | H01R 13/42 |
| RU | 2231185 | | 6/2004 | H01R 13/627 |

OTHER PUBLICATIONS

International Preliminary Report on Patentability issued in corresponding PCT Patent Appln. PCT/DE2014/100271 dated Feb. 9, 2016 (9 pgs).

Russian Decision to Grant (w/translation) issued in application No. 201606332/07, dated Aug. 29, 2017 (9 pgs).

* cited by examiner

PLUG CONNECTOR MODULE PROVIDING GROUND CONNECTION THROUGH A MODULE HOLDING FRAME

BACKGROUND OF THE INVENTION

The invention relates to an electrical plug connector module that is provided for inserting into a modular plug connector.

Electrical plug connector modules of this type are provided for receiving at least one electrical contact element. Plug connector modules can comprise an electrical contact element—for example a grounding contact, a so-called pin electronics or PE-contact—or a plurality of contact elements—for example for transmitting data.

A modular, individual plug connector can be formed by virtue of combining various plug connector modules.

Many electrical plug connector modules that are used in industry are already known from the prior art. Depending upon the application, plug connector modules are embodied with a high number of contacts or a low number of contacts.

DE 694 13 524 T2 discloses an electrical connector for connecting at least one pair of lead wires to at least one pair of interconnecting wires and comprising an insulated base part, a first plug part that can be connected to the base part in a detachable manner, a second plug part that can be stacked with the first plug part in a detachable manner and a pair of metal contact elements in each of the plug parts.

DE 298 12 500 U1 discloses a modular plug connector having a supporting frame for receiving multiple modules. The modules are supported in each case on a first longitudinal edge of the supporting frame and are locked by means of independent locking elements on the longitudinal edge.

DE 20 2011 050 643 U1 discloses a plug connector module that comprises latching elements that are provided so as to latch the plug connector module in at least one housing half of a plug connector.

DE 295 08 095 U1 discloses a further module inserting frame for receiving contact modules for insertion in the plug connector housing.

It is common for all plug connector modules that they comprise an electrically non-conductive housing in order to insulate the electrical contacts in the interior with respect to one another.

Plug connector modules are hitherto preferably inserted in a holding frame in lieu of inserting said plug connector modules being inserted directly into a plug connector. A holding frame of this type for receiving plug connector modules can receive one or multiple plug connector modules depending upon the construction size.

After arranging and fixing the plug connector modules in a holding frame of this type, said holding frame can be inserted with the plug connector modules that are received therein into a plug connector housing and thus form the modular plug connector.

It is disadvantageous in the case of modular plug connectors of this type that it is necessary to provide a connection to ground for the plug connector or the holding frame separately. The connection to ground that is provided by means of an electrical, multi-wire conductor must also be provided for the plug connector housing and/or the holding frame.

OBJECT OF THE INVENTION

The object of the invention is to propose an electrical plug connector module that renders it possible in a simple manner to establish a contact with and provide a connection to ground for a plug connector housing and/or a module holding frame.

The object is achieved by means of the characterizing features of the independent claim 1.

SUMMARY OF THE INVENTION

The one or the multiple plug connector modules are inserted together directly into a plug connector housing for this purpose. Alternatively, the plug connector modules are received and fixed together in a holding frame that is provided. The holding frame can then in turn be inserted into a plug connector housing.

The electrical plug connector module in accordance with the invention is formed from a housing in which at least one electrical contact element is received. It is preferred that the housing is embodied from an electrically non-conductive material in order to electrically insulate the electrical contact element with respect to the plug connector housing and other plug connector modules.

The electrical contact elements that are received in the housings are formed from a connecting side and a plugging side. The plugging side is used so as to contact a second contact element that is located in a mating plug connector. The plugging side can be embodied both as a pin contact or socket contact. Other embodiments of plugging sides that are known from the prior art for electrical contact elements—for example hermaphroditic plugging sides—are feasible and can be used.

The connecting side of the electrical contact element is used so as to connect and to make contact with an electrical conductor that is to be connected to the plug connector/the plug connector module. A plurality of possibilities and embodiments are known for this purpose from the prior art.

In addition to multiple connecting opportunities such as a screw connector or a cage tension spring, other solutions that can be used only once are likewise possible. Exemplary cutting clamps or crimp connectors are mentioned in this case. The possibilities for the conductor connection on the electrical contact element are numerous.

The electrical contact element is arranged in the housing of the electrical plug connector module so that the plugging side of the contact element is located in the plugging direction on a plugging side of the housing. The plugging side of the housing is provided for the purpose of making contact with the plugging side of an electrical plug connector module and for said components to be plugged into one another. It is thus rendered possible to make contact with the electrical contact elements.

A connecting side is provided on the housing lying opposite the plugging side of the housing. The connecting side of the housing renders it possible to access to the connecting side of the electrical contact element in order to connect an electrical conductor to the electrical contact element.

In addition, fixing means are provided on the housing of the electrical plug connector module, said fixing means being used so as to fasten and fix the electrical plug connector module in an electrical plug connector or a holding frame.

The fixing means can be for example latching lugs or resilient elements depending upon the embodiment of the modular plug connector and said latching lugs or resilient elements latch in the plug connector or in the holding frame. The fixing means can also be embodied as simple formations on the housing that are inserted into corresponding recesses in the plug connector housing or holding frame and thus produce a positive-locking connection.

A plurality of solutions for embodying the fixing means and that can all be transferred to or used with the present invention are already known from the prior art.

In accordance with the invention, the electrical plug connector module comprises an electrical contact means that is connected in an electrically conductive manner to the electrical contact element in the interior of the housing. In addition, the electrical contact element is embodied in such a manner that said contact element is guided from the interior of the housing to its outer side.

The electrical contact element is used in accordance with the invention for the purpose of establishing an electrical contact with the plug connector that receives the electrical plug connector module.

In a further embodiment, the electrical contact element does not make direct contact with the plug connector but rather contacts a holding frame that receives the modules of the plug connector and makes contact with said modules.

It is possible by means of the electrical contact element in accordance with the invention to establish an electrical contact of a contact element in the plug connector module to the plug connector or to the holding frame.

By virtue of using the electrical contact element on electrical contact elements that provide a connection to ground, the object in accordance with the invention is thus achieved in that it is possible to connect the plug connector housing and the holding frame to ground in a simple manner.

By virtue of inserting the electrical plug connector module that comprises a connection to ground into a plug connector housing or a holding frame, the electrical contact means of the plug connector module contacts the plug connector housing or the holding frame without additional intervention.

DETAILED DESCRIPTION OF THE INVENTION

Figure 1:
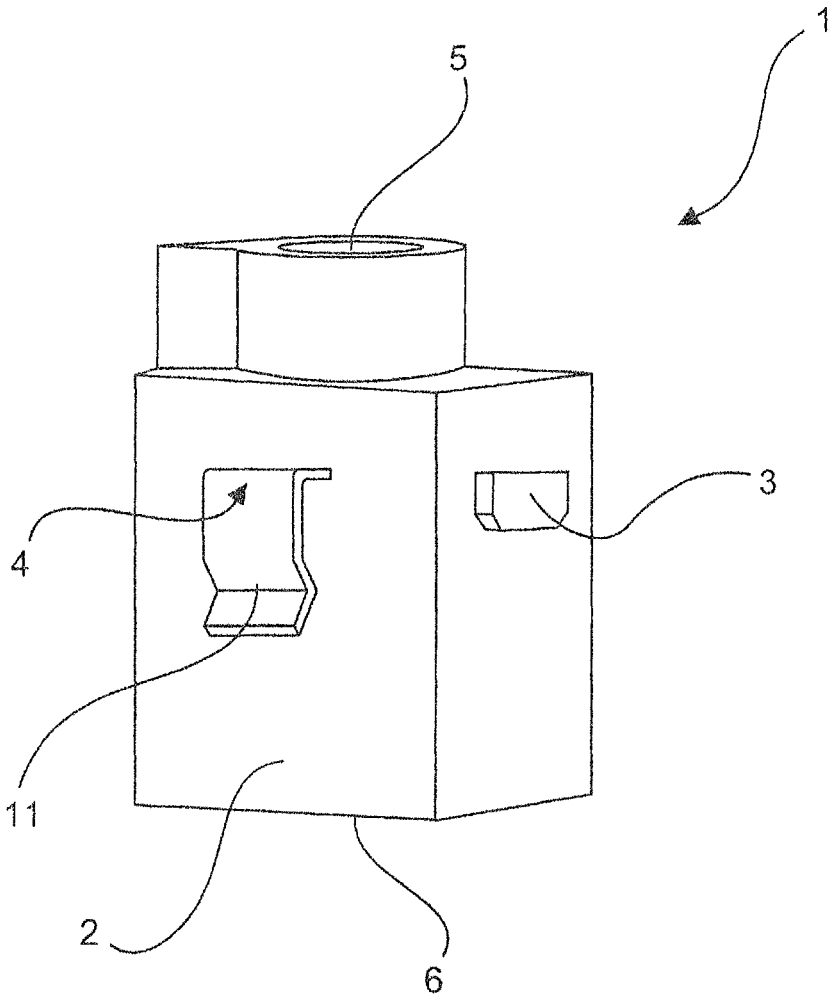
FIG. 1 illustrates perspective view of a plug connector module in accordance with the invention.

FIG. 1 illustrates an electrical plug connector module 1 in a perspective view. The electrical plug connector module 1 that is formed from an insulating housing 2 comprises a first plugging side 6 in the lower region that is illustrated, and also a first connecting side 5 in the upper region that is illustrated.

The first plugging side 6 of the electrical plug connector module 1 is provided so as to contact a further electrical plug connector module. The first connecting side 5 is used so as to establish a contact between an electrical conductor and an electrical contact 8 that is arranged in the electrical plug connector module 1.

The electrical plug connector module 1 comprises two fixing means 3 on the side. A further one of the fixing means 3 is evident by means of the illustration. The fixing means 3 are used for receiving the electrical plug connector module 1 in a holding frame 7 in a positive-locking manner. The manner in which the electrical plug connector module 1 is received in the holding frame 7 is more precisely illustrated in FIG. 2.

In accordance with the invention, a contact means 4 is provided on the electrical plug connector module 1. The electrically conductive contact means 4 is embodied outside the housing 2 as a resilient region 11. The contact means 4 is used for establishing an electrical contact between the electrical plug connector module 1 and the holding frame 7 in which the electrical plug connector module 1 is to be inserted.

For this purpose, the form of the resilient region 11 is essentially roughly L-shaped, wherein a spacing is formed between resilient region 11 and housing 2. The spacing between the resilient region 11 and housing 2 is tapered by means of an S-shaped formation of the last end of the resilient region 11. The holding frame 7 can thus be arranged in a resilient manner between the resilient region 11 and the housing 2 of the electrical plug connector module 1.

Figure 2:
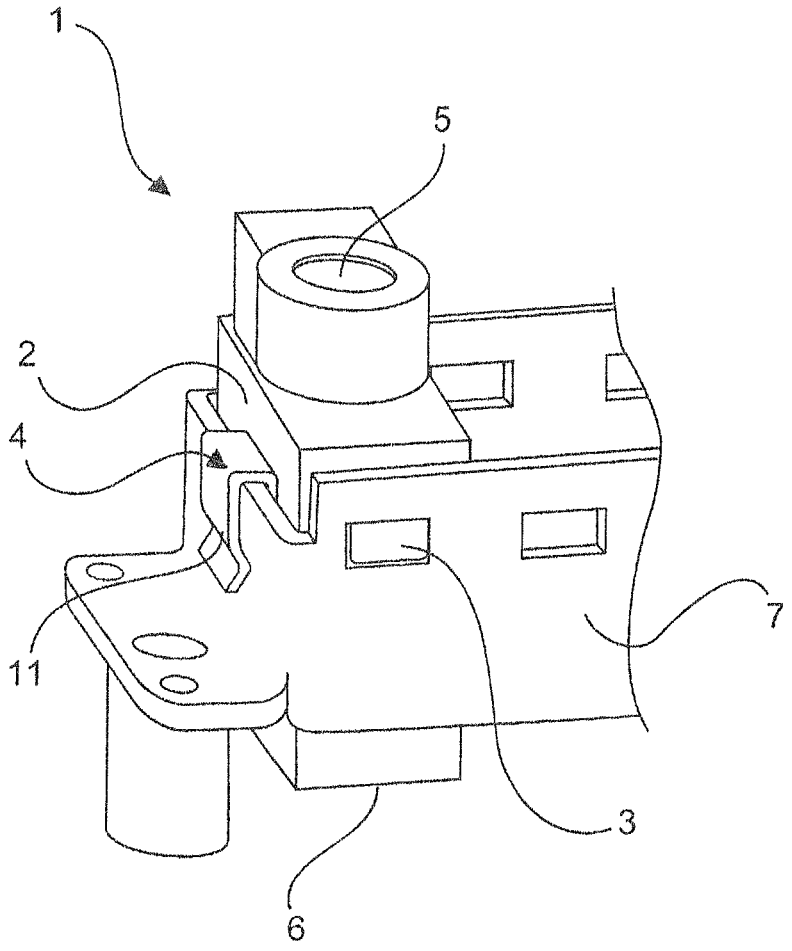
FIG. 2 illustrates a perspective view of a plug connector module in accordance with the invention, said plug connector module being inserted in a holding frame.

FIG. 2 illustrates the electrical plug connector module from FIG. 1, said plug connector module being inserted into a holding frame 7. The holding frame 7 is used so as to receive a plurality of plug connector modules. The holding frame 7 is in turn inserted in a plug connector housing with inserted plug connector modules and thus forms a modular plug connector.

The fixing means 3 of the electrical plug connector module 1 engage in a positive-locking manner in a recesses in the holding frame 7 and are thus used so as to fasten the electrical plug connector module 1 in the holding frame 7.

In accordance with the invention, the contact means 4 engages with its free end that is embodied as a resilient region 11 over the holding frame 7. An electrical contact with the holding frame 7 is thus ensured by way of the S-shaped end of the resilient region 11.

Figure 3:
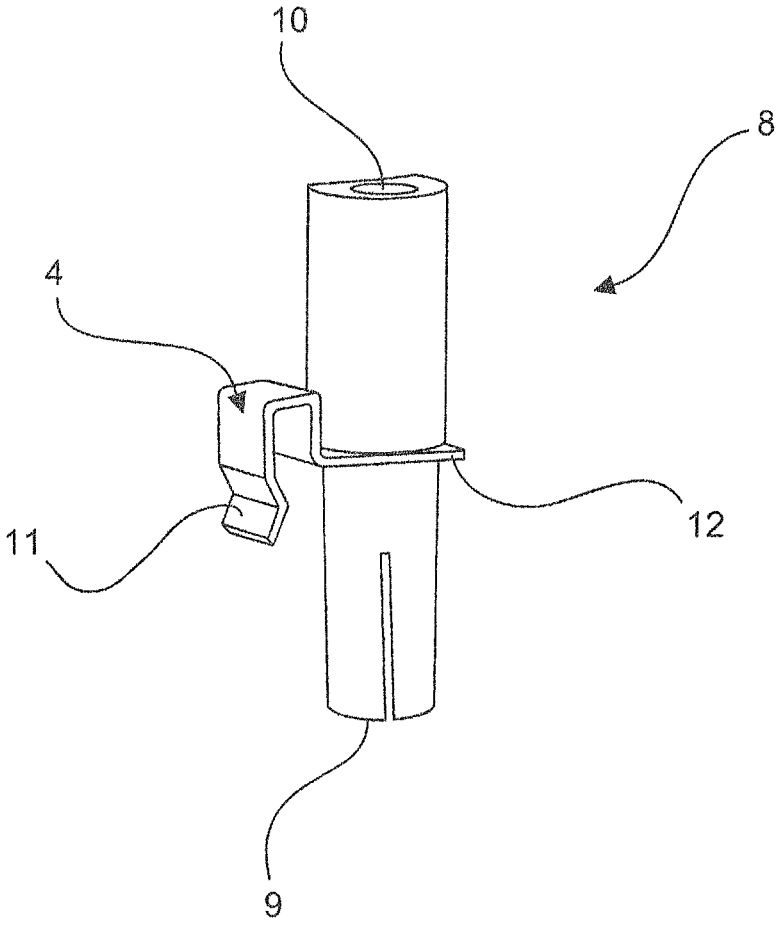
FIG. 3 illustrates an individual insulated electrical contact with electrical contact means.

The electrical contact 8 of the electrical plug connector module 1 that is received in the housing 2 is illustrated in FIG. 3 individually together with the contact means 4 in accordance with the invention. The electrical contact 8 is essentially formed from a second connecting side 10 and a second plugging side 9.

Figure 3A:
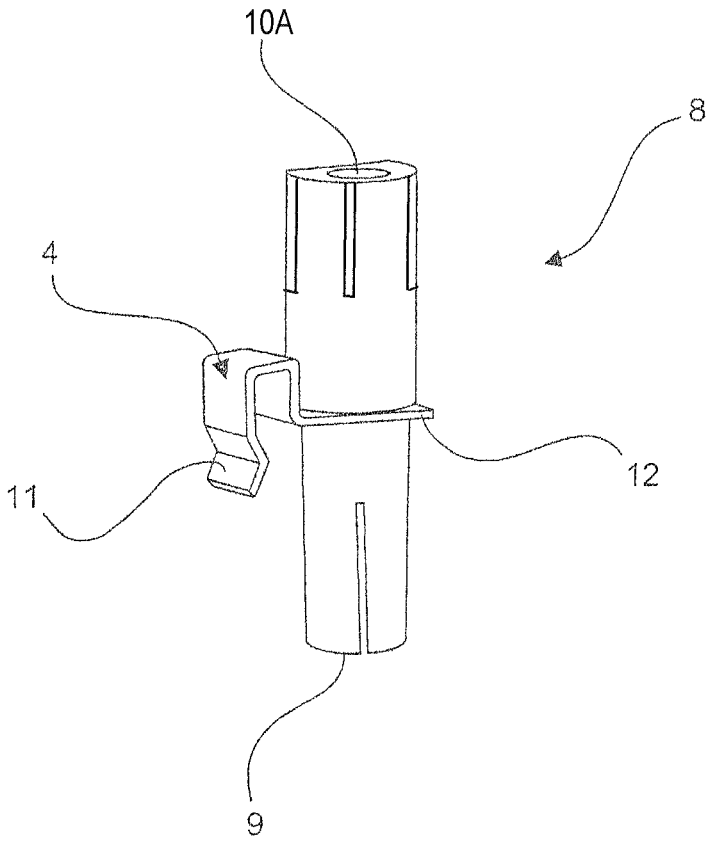
FIGS. 3A-3C are similar to FIG. 3 and illustrate alternative forms of electrical contact connections.
Figure 3B:
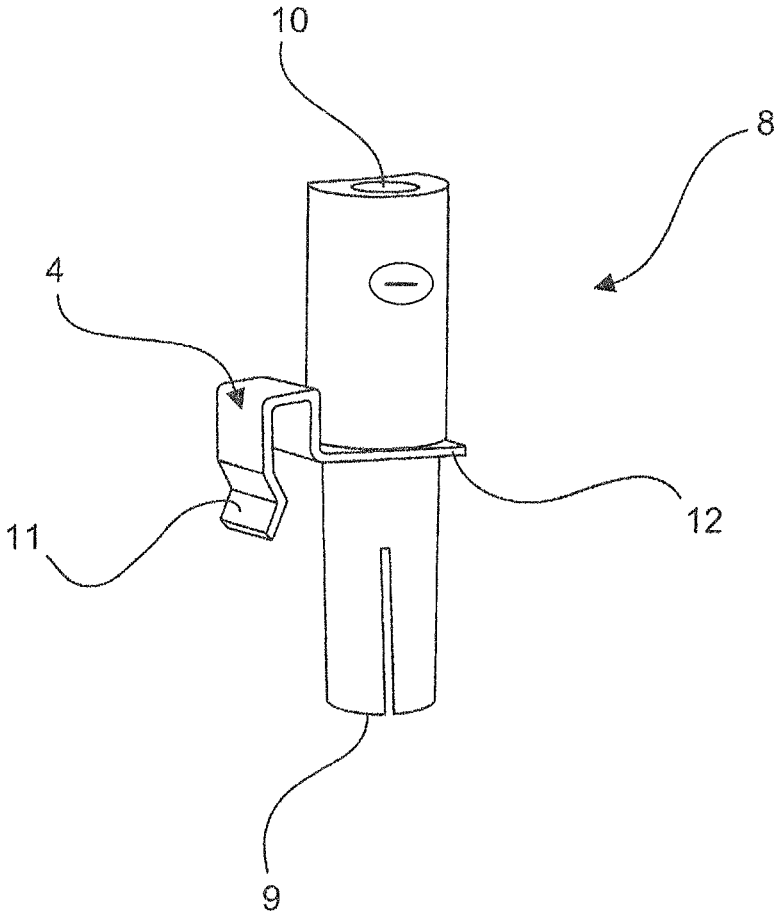
Figure 3C:
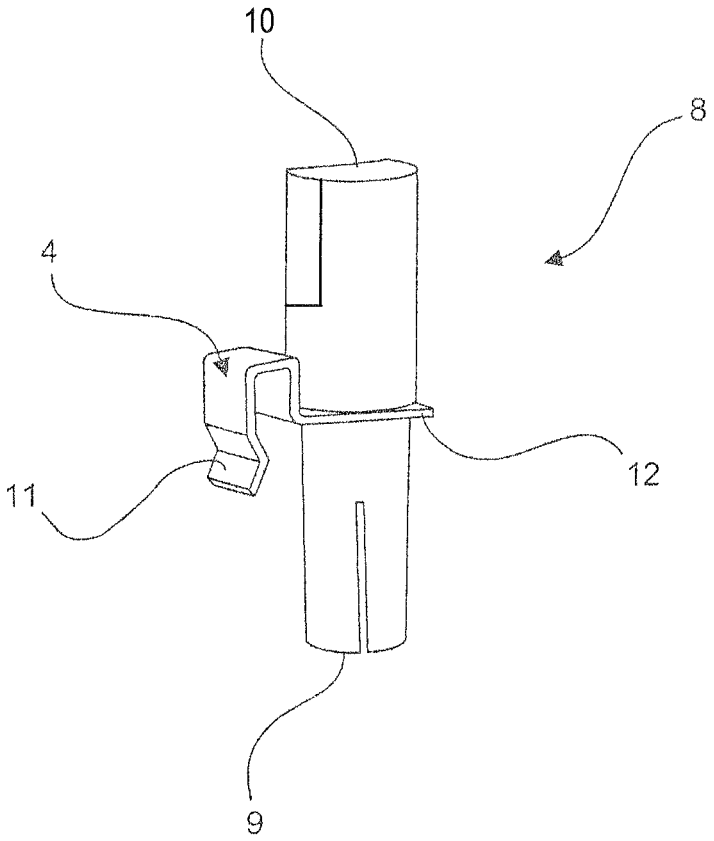

The second plugging side 9 is used so as to make contact with a further electrical contact. An electrical conductor can be received, fixed and electrically contacted on the second connecting side 10. For this purpose, the second connecting side 10 can be embodied both as a crimped region 10A (FIG. 3A) as well as a screw connection 10B (FIG. 3B) or a soldered connection 10C (FIG. 3C). Other methods that are known from the prior art for making contact with a conductor on a contact can be used in a transferable manner.

The contact means 4 is connected to the electrical contact 8 in the centre region between the second connecting sides 10 and the second plug side 9 of the electrical contact 8. The contact means 4 is formed for this purpose from the resilient region 11 and a connecting region 12 in this illustrated embodiment.

The resilient region 11 is used—as previously illustrated—for electrically contacting the holding frame 7. The electrical contact means 4 is connected to the electrical contact 8 in the connecting region 12. The connection to ground that is present on the electrical contact 8 can thus be transferred by means of the electrical contact means 4 to the holding frame 7.

The invention claimed is:

1. An electrical plug connector module and a frame assembly for insertion into a modular plug connector, wherein said frame assembly comprises a holding frame for accommodating two or more electrical plug connector modules, and having one or more electrical plug connector modules fixed in the holding frame, the electrical plug connector modules each comprising an insulating housing and at least one electrical contact, wherein the insulating housing comprises fixing devices for fixing the electrical plug connector module in the holding frame, and wherein the at least one electrical contact is received in the insulating housing and comprises a second plugging side and also a second connecting side that can be accessed from a first plugging side and a first connecting side of the insulating housing respectively, wherein the electrical plug connector module further comprises a contact means that is connected to the at least one electrical contact in an electrically conductive manner and is guided to an outer side of the insulating housing, wherein the contact means is embodied on the outer side of the insulating housing as an L-shaped resilient region having an S-shaped formation at a distal end of the L-shaped region, wherein the electrical plug connector module is inserted into the holding frame, wherein the holding frame is arranged in the modular plug connector, and the resilient region of the contact means contacts the holding frame.

2. The electrical plug connector module and frame assembly as claimed in claim 1, wherein the contact means comprises a connecting region that is connected in an electrically conductive manner to the electrical contact.

3. The electrical plug connector module and frame assembly as claimed in claim 1, wherein the resilient region of the contact element contacts the holding frame in a resilient and electrical manner.

4. The electrical plug connector module and frame assembly as claimed in claim 2, wherein the resilient region of the contact means contacts the holding frame in a resilient and electrical manner.

5. The electrical plug connector module and frame assembly as claimed in claim 3, wherein the resilient region of the contact means contacts the holding frame in an electrically conductive manner when the electrical plug connector module is inserted into the holding frame.

6. The electrical plug connector module and frame assembly as claimed in claim 4, wherein the resilient region of the contact means contacts the holding frame in an electrically conductive manner when the electrical plug connector module is inserted into the holding frame.

7. The electrical plug connector module and frame assembly as claimed in claim 1, wherein the second connecting side comprises a crimp connecting region.

8. The electrical plug connector module and frame assembly as claimed in claim 1, wherein the second connecting side comprises a screw connecting region.

9. The electrical plug connector module and frame assembly as claimed in claim 1, wherein the second connecting side comprises a solder connecting region.

* * * * *